US011181036B2

(12) United States Patent
Takazawa et al.

(10) Patent No.: US 11,181,036 B2
(45) Date of Patent: Nov. 23, 2021

(54) COOLING WATER CONTROL APPARATUS FOR INTERNAL COMBUSTION ENGINE

(71) Applicant: Honda Motor Co., Ltd., Tokyo (JP)

(72) Inventors: Masanobu Takazawa, Saitama (JP); Hajime Uto, Saitama (JP); Masayuki Toyokawa, Saitama (JP); Naoaki Takeda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/745,384

(22) Filed: Jan. 17, 2020

(65) Prior Publication Data

US 2020/0240318 A1 Jul. 30, 2020

(30) Foreign Application Priority Data

Jan. 28, 2019 (JP) ..... JP2019-011881

(51) Int. Cl.

*F01P 7/14* (2006.01)
*F01P 7/16* (2006.01)
*F01P 11/20* (2006.01)

(52) U.S. Cl.

CPC ..... *F01P 7/165* (2013.01); *F01P 2007/146* (2013.01); *F01P 2011/205* (2013.01)

(58) Field of Classification Search

CPC . F01P 7/165; F01P 2007/146; F01P 2011/205
USPC ..... 123/41.1
See application file for complete search history.

(56) References Cited

U.S. PATENT DOCUMENTS 4,545,333 A * 10/1985 Nagumo ..... F01P 7/167 123/41.02
2009/0241863 A1* 10/2009 Kimura ..... B60H 1/025 123/41.1
2016/0348567 A1* 12/2016 Watanabe ..... F01P 7/167

FOREIGN PATENT DOCUMENTS

CN 204827634 12/2015
CN 106523238 3/2017
JP 2003184552 7/2003
JP 2003184552 A * 7/2003 ..... F01P 3/20
WO 2015124263 8/2015

OTHER PUBLICATIONS

Office Action of China Counterpart Application, with English translation thereof, dated Jun. 22, 2021, pp. 1-16.

* cited by examiner

*Primary Examiner* — Logan M Kraft
*Assistant Examiner* — Anthony Donald Taylor, Jr.
(74) *Attorney, Agent, or Firm* — JCIPRNET

(57) ABSTRACT

The cooling water control apparatus of the disclosure includes: a cooling water circuit; a heat accumulator which is arranged in the cooling water circuit and stores high-temperature cooling water flowing out from an internal combustion engine; an on-off valve for opening/closing the cooling water circuit; a heater passage which is connected in parallel to the cooling water circuit; and a flow rate control valve which controls a flow rate of the cooling water inside the heater passage. The cooling water inside the heat accumulator is supplied to the internal combustion engine by closing the flow rate control valve and opening the on-off valve in order to promote warm-up at the start of the internal combustion engine, and thereafter, the on-off valve is closed, and an opening degree of the flow rate control valve is controlled to make the temperature of the internal combustion engine reach a specified target temperature.

6 Claims, 5 Drawing Sheets

COOLING WATER CONTROL APPARATUS FOR INTERNAL COMBUSTION ENGINE

CROSS-REFERENCE TO RELATED APPLICATION

This application claims the priority of Japan patent application serial no. 2019-011881, filed on Jan. 28, 2019. The entirety of the above-mentioned patent application is hereby incorporated by reference herein and made a part of this specification.

BACKGROUND OF THE DISCLOSURE

Technical Field

The disclosure relates to a cooling water control apparatus for internal combustion engine which controls flow of cooling water for cooling an internal combustion engine, and particularly relates to a cooling water control apparatus which supplies high-temperature cooling water accumulated in a heat accumulator to the internal combustion engine and dissipates heat in order to promote warm-up.

Related Art

As a conventional cooling water control apparatus of this type, for example, the cooling water control apparatus recited in patent literature 1 (Japanese Patent Laid-Open No. 2003-184552) is known. The cooling water control apparatus includes: a cooling water circuit in which cooling water circulates due to operation of a water pump; a heat accumulator which is arranged in the cooling water circuit and stores high-temperature cooling water flowing out from an internal combustion engine; a heater passage which is connected in parallel to the cooling water circuit and in which a heater core for heating a vehicle by utilizing heat of the cooling water is arranged; and a switching valve for switching flow paths of the cooling water. The switching valve makes the cooling water flowing out from the internal combustion engine pass through the heat accumulator and circulate via the cooling water circuit at a first position, makes the cooling water flowing out from the internal combustion engine circulate via the heater passage without passing through the heat accumulator at a second position, and keeps the cooling water inside the heat accumulator.

In the cooling water control apparatus, the switching valve is switched from the second position to the first position at the cold start of the internal combustion engine. Thereby, the warm-up is promoted by supplying the high-temperature cooling water stored in the heat accumulator to the internal combustion engine via the cooling water circuit. Thereafter, when the discharge of the high-temperature cooling water from the heat accumulator ends, by switching the switching valve from the first position to the second position, the supply of the cooling water from the heat accumulator is stopped and the cooling water flowing out from the internal combustion engine circulates via the heater passage.

As described above, in the conventional cooling water control apparatus, at the cold start of the internal combustion engine, the high-temperature cooling water inside the heat accumulator is supplied to the internal combustion engine by switching the switching valve to the first position, and the warm-up is promoted. However, in the cooling water control apparatus, the switching valve is switched to the second position thereafter, and the cooling water circulates via the heater passage, and thus low-temperature cooling water present in the heater passage flows into the internal combustion engine. As a result, an advantage by the warm-up cannot be satisfactorily obtained, for example, the internal combustion engine of which a temperature is raised by the heat dissipated from the heat accumulator experiences a drastically temperature decrease, and fuel consumption or exhaust characteristics deteriorates.

SUMMARY

In an embodiment of the disclosure, a cooling water control apparatus for internal combustion engine which controls flow of cooling water for cooling an internal combustion engine 2 is provided. The cooling water control apparatus for internal combustion engine includes: a cooling water circuit 3 in which the cooling water circulates through the internal combustion engine 2 due to operation of a water pump 14; a heat accumulator 13 which is arranged in the cooling water circuit 3 and accumulates heat of the cooling water by storing high-temperature cooling water flowing out from the internal combustion engine 2; an on-off valve 12 which allows/blocks the flow of the cooling water passing through the heat accumulator 13 by opening/closing the cooling water circuit 3; a bypass passage (a heater passage 4) which is connected in parallel to the cooling water circuit 3 in a manner of bypassing the heat accumulator 13 and in which an equipment (a heater core 15 in an embodiment (hereinafter, the same applies in this technical solution)) which utilizes the heat of the cooling water and is separated from the heat accumulator 13 is arranged; a flow rate control valve (a second flow rate control valve 17) which controls a flow rate of the cooling water flowing through the bypass passage; and a control part (an ECU 10, steps 5-7, steps 11-12, 16 in FIG. 3) which supplies, in order to promote warm-up at the start of the internal combustion engine 2, the cooling water inside the heat accumulator 13 to the internal combustion engine 2 by opening the on-off valve 12 at a state that the flow rate control valve is closed, and thereafter, controls an opening degree of the flow rate control valve (a second valve opening degree AV2) to make the temperature of the internal combustion engine 2 reach a specified target temperature TWCMD at a state that the on-off valve 12 is closed.

DESCRIPTION OF THE EMBODIMENTS

One or some exemplary embodiments of the disclosure provide a cooling water control apparatus for internal combustion engine which can effectively perform warm-up by supplying high-temperature cooling water from a heat accumulator to an internal combustion engine at the start of the internal combustion engine, and thereafter, suppress temperature reduction of the internal combustion engine already raised in temperature and maintain a warm-up effect to thereby improve fuel consumption, exhaust characteristics, and the like.

According to the above configuration, the cooling water control apparatus includes, as a flow path of the cooling water of the internal combustion engine, the cooling water circuit in which the heat accumulator which accumulates the heat of the cooling water is arranged, and the bypass passage which is connected in parallel to the cooling water circuit in a manner of bypassing the heat accumulator and in which the separate equipment which utilizes the heat of the cooling water is arranged. In addition, the cooling water control apparatus includes the on-off valve for opening/closing the cooling water circuit and the flow rate control valve for controlling the flow rate of the cooling water flowing through the bypass passage.

At the start of the internal combustion engine, the on-off valve is opened at the state that the flow rate control valve is closed. By opening the on-off valve, the high-temperature cooling water stored in the heat accumulator is supplied to the internal combustion engine via the cooling water circuit, and the heat of the cooling water is dissipated, thereby promoting the warm-up. In this case, by controlling the flow rate control valve at the close state, the low-temperature cooling water inside the bypass passage is not supplied to the internal combustion engine and is not mixed into the high-temperature cooling water from the heat accumulator. As described above, the warm-up can be effectively promoted by dissipating the heat of the cooling water from the heat accumulator.

In addition, thereafter, the on-off valve is closed, and the opening degree of the flow rate control valve is controlled to make the temperature of the internal combustion engine reach the specified target temperature. The supply of the cooling water from the heat accumulator is ended by closing the on-off valve. At the same time, the temperature of the internal combustion engine is controlled to the target temperature by controlling the opening degree of the flow rate control valve. Accordingly, after the supply of the high-temperature cooling water from the heat accumulator is ended, the temperature reduction of the internal combustion engine already raised in temperature is suppressed and the warm-up effect is maintained, and thereby the fuel consumption, the exhaust characteristics, and the like can be improved.

Figure 3:
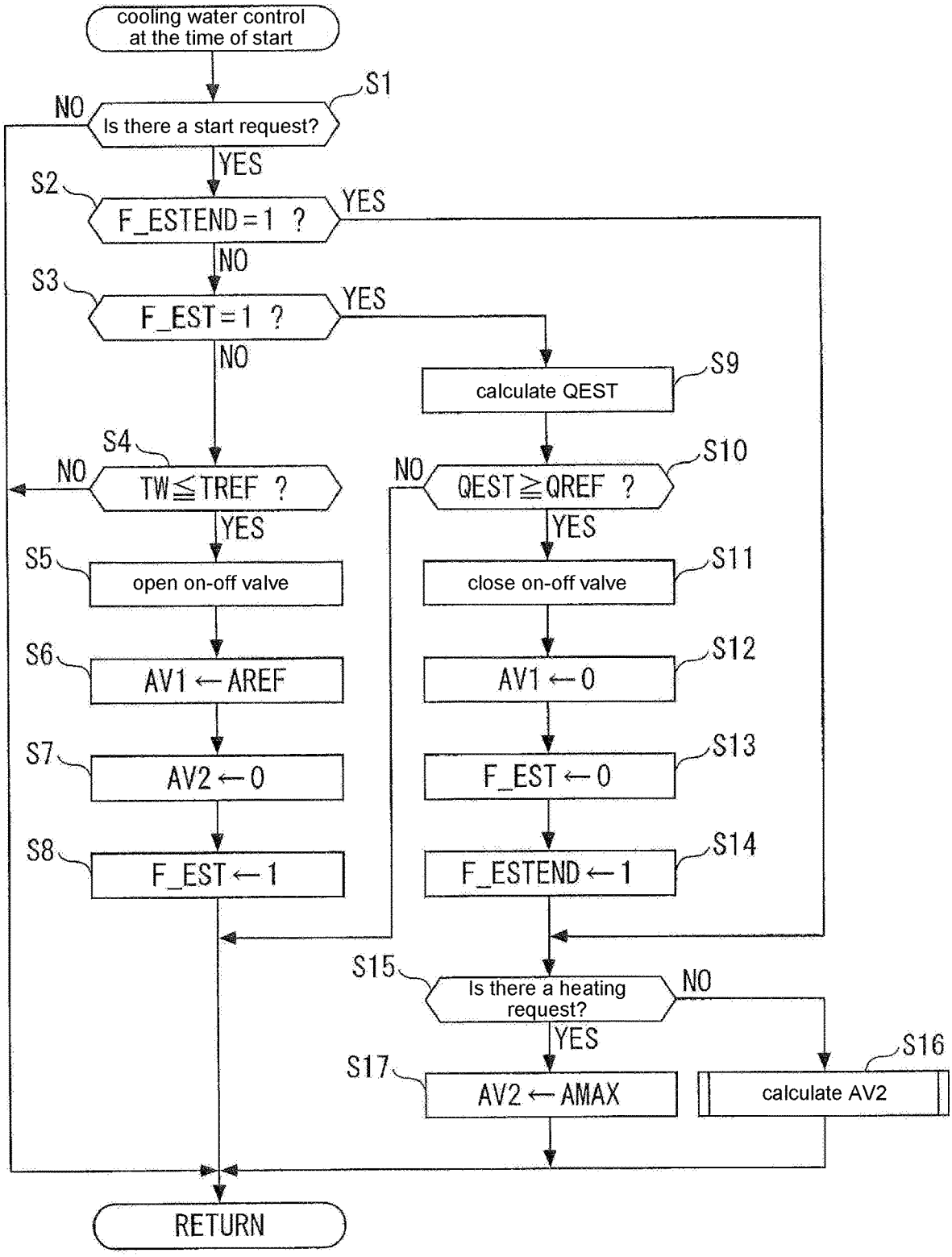
FIG. 3 is a flowchart showing a cooling water control process at the start which is executed in the cooling water control apparatus.
Figure 4:
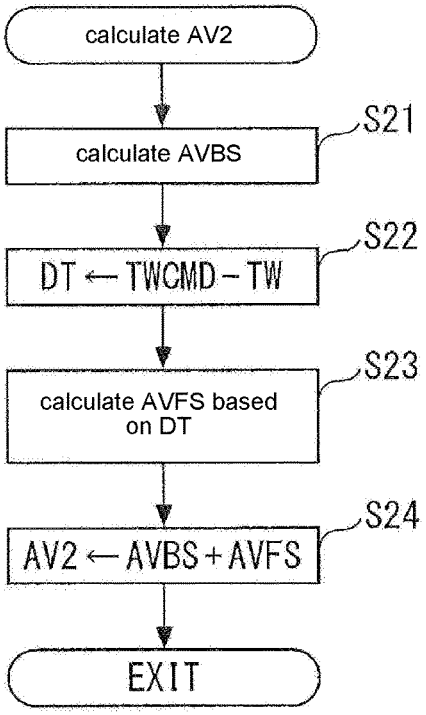
FIG. 4 is a flowchart showing a calculation process of an opening degree of a second flow rate control valve according to a first embodiment.

In an embodiment of the disclosure, the cooling water control apparatus for internal combustion engine further includes a cooling water temperature detection part (an engine water temperature sensor 51) which detects a temperature (an engine water temperature TW) of cooling water at an outlet of the internal combustion engine 2 (a cooling water outlet 2*a*) as the temperature of the internal combustion engine 2, and the control part controls the opening degree of the flow rate control valve by feedback control to make the detected temperature of the cooling water converge to the target temperature TWCMD (step 16 in FIG. 3, FIG. 4).

In this configuration, the temperature of the cooling water at the outlet of the internal combustion engine is detected as the temperature of the internal combustion engine. Compared with a temperature at an inlet, the temperature of the cooling water at the outlet of the internal combustion engine better reflects an actual temperature or a combustion state of the internal combustion engine which changes in accordance with influence of the heat or the like generated by the internal combustion engine. Besides, the opening degree of the flow rate control valve is controlled by feedback control to make the detected temperature of the cooling water at the outlet of the internal combustion engine converge to the target temperature, and thus the actual temperature of the internal combustion engine is precisely controlled to the target temperature, and the warm-up effect can be effectively maintained.

Figure 7:
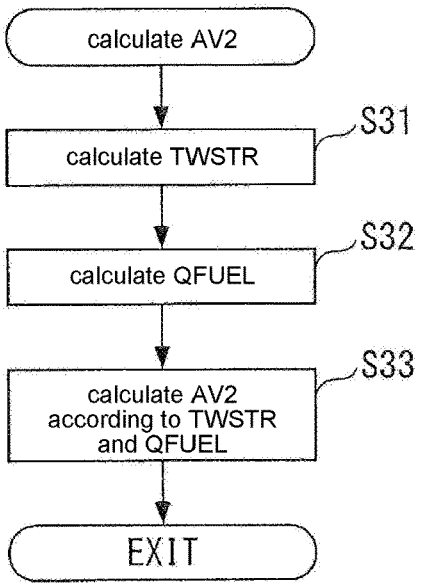
FIG. 7 is a flowchart showing a calculation process of an opening degree of a second flow rate control valve according to a second embodiment.

In an embodiment of the disclosure, the cooling water control apparatus for internal combustion engine further includes: a cooling water temperature acquisition part (the engine water temperature sensor 51, the ECU10, step 31 in FIG. 7) which acquires the temperature of the cooling water at the beginning of the start of the internal combustion engine 2 (a start beginning water temperature TWSTR); and an output parameter acquisition part (the ECU10, step 32 in FIG. 7) which acquires an output parameter (an after-start fuel injection amount QFUEL) representing output of the internal combustion engine 2 which is generated after the beginning of the start. The control part controls, based on the acquired temperature and the output parameter of the cooling water, the opening degree of the flow rate control valve by feed-forward control to make the temperature of the internal combustion engine 2 reach the target temperature TWCMD (step 33 in FIG. 7).

The temperature during the start of the internal combustion engine is generally determined according to the temperature of the cooling water at the beginning of the start and the output of the internal combustion engine, that is, the amount of heat generated after the beginning of the start. According to the above configuration, these two parameters are acquired, and based on these two parameters, the opening degree of the flow rate control valve is controlled by the feed-forward control to make the temperature of the internal combustion engine reach the target temperature. Thereby, the feed-forward control which is simpler than the feedback control can be used to control the temperature of the internal combustion engine to the target temperature, and the warm-up effect can be maintained.

In an embodiment of the disclosure, the target temperature TWCMD is set to a specified lower limit value at which a reduction in fuel consumption is caused when the temperature of the internal combustion engine 2 is lower than the target temperature TWCMD.

According to the above configuration, since the target temperature of the internal combustion engine is set as described above, after the supply of the cooling water from the heat accumulator is ended, the opening degree of the flow rate control valve is controlled to make the temperature of the internal combustion engine reach the target temperature, and thereby the reduction in the fuel consumption can be appropriately prevented.

In an embodiment of the disclosure, the internal combustion engine 2 is equipped in a vehicle, and the separate equipment arranged in the bypass passage is a heater core 15 for heating the vehicle.

In this configuration, the internal combustion engine is equipped in the vehicle, and the heater core for heating the vehicle is arranged, as the separate equipment utilizing the heat of the cooling water, in the bypass passage which bypasses the heat accumulator. Generally, since the heater core is used for heating the vehicle and a large amount of heat is required, a volume of the bypass passage in which the heater core is arranged is great. Therefore, according to the above configuration, the effect of this application, that is, after the supply of the high-temperature cooling water from the heat accumulator is ended, the temperature reduction of the internal combustion engine already raised in temperature is suppressed and the warm-up effect is maintained, can be particularly effectively obtained.

In an embodiment of the disclosure, the control part controls the flow rate control valve to a fully open state regardless of a relationship between the temperature of the internal combustion engine 2 and the target temperature TWCMD when heating of the vehicle is requested after the cooling water inside the heat accumulator 13 is supplied to the internal combustion engine (step 17 in FIG. 3).

According to the above configuration, when the heating of the vehicle is requested after the cooling water of the heat accumulator is supplied to the internal combustion engine, the flow rate control valve is controlled to the fully open state regardless of the relationship between the temperature of the internal combustion engine and the target temperature. Thereby, the heating of the vehicle can be performed with priority while maximally utilizing the heat of the cooling water in the heater core.

Embodiments of the disclosure are specifically described below with reference to the drawings. A cooling water control apparatus 1 according to an embodiment shown in FIG. 1 controls flow of cooling water for cooling an internal combustion engine 2. The internal combustion engine 2 (hereinafter referred to as "the engine 2") is equipped as a motive power source in a vehicle (not shown). The cooling water is composed of, for example, LLC (Long Life Coolant).

The cooling water control apparatus 1 includes, as passages through which the cooling water flows, a cooling water circuit 3, a heater passage 4, a radiator circuit 5, and a thermo passage 6.

One end of the cooling water circuit 3 is connected to a cooling water outlet 2*a* of a water jacket (not shown) of the engine 2 and the other end is connected to a cooling water inlet 2*b*. In the cooling water circuit 3, a first flow rate control valve 11 for controlling a flow rate of the cooling water in the cooling water circuit 3, an on-off valve 12 for opening/closing the cooling water circuit 3, a heat accumulator 13, and an electric water pump 14 for circulating the cooling water are arranged in order from a upstream side.

In the cooling water circuit 3 having the above configuration, if the water pump 14 is driven, in a state that the on-off valve 12 is opened, cooling water flowing out from the cooling water outlet 2*a* of the engine 2 circulates in a manner of passing through the heat accumulator 13 to flow through the cooling water circuit 3 and returning to the engine 2 via the cooling water inlet 2*b*. In addition, a flow rate of the cooling water flowing through the cooling water circuit 3 is controlled by the first flow rate control valve 11. In addition, the heat accumulator 13 has a double structure of inside structure and outside structure, stores the high-temperature cooling already raised in temperature during the operation of the engine 2 in an adiabatic state, and supplies the high-temperature cooling water to the engine 2 at cold start or the like to promote warm-up.

The heater passage 4 branches from an upstream side of the first flow rate control valve 11 in the cooling water circuit 3, joins at the immediate upstream side of the water pump 14, and is connected in parallel to the cooling water circuit 3 in a manner of bypassing the first flow rate control valve 11 and the heat accumulator 13. In the heater passage 4, a heater core 15, an exhaust heat recovery part 16, and a second flow rate control valve 17 are arranged in order from the upstream side. The second flow rate control valve 17 is disposed near a joining portion of the heater passage 4 with the cooling water circuit 3.

In the heater passage 4 having the above configuration, in a state that the water pump 14 operates and the second flow rate control valve 17 is opened, the cooling water flowing out from the cooling water outlet 2*a* of the engine 2 circulates in a manner of passing through the heater core 15 and the exhaust heat recovery part 16 to flow through the heater passage 4 and returns to the engine 2 via the cooling water inlet 2*b*. In addition, the flow rate of the cooling water flowing through the heater passage 4 is controlled by the second flow rate control valve 17.

The heater core 15 raises the temperature of the air by heat exchange with the cooling water flowing through the heater passage 4 and heats the vehicle by sending the air in to a compartment. In addition, the exhaust heat recovery part 16 recovers heat of the exhaust gas exhausted from the engine 2 to the cooling water inside the heater passage 4, thereby promoting the warm-up or the like.

The radiator circuit 5 includes an upstream portion 5*a* and a downstream portion 5*b*. One end of the upstream portion 5*a* is connected to a second cooling water outlet 2*c* of the engine 2, and the other end is connected to the immediate upstream side of the second flow rate control valve 17 of the heater passage 4. The downstream portion 5*b* is configured by sharing a part of the heater passage 4 in which the second flow rate control valve 17 is arranged and a part of the cooling water circuit 3 in which the water pump 14 is arranged and which reaches the cooling water inlet 2*b* of the engine 2.

In the upstream portion 5*a* of the radiator circuit 5, a radiator 18 and a thermostat 19 are arranged in order from an upstream side. The thermostat 19 is connected to a third cooling water outlet 2*d* of the engine 2 via the thermo passage 6, and opens the radiator circuit 5 when the temperature of the flow-in cooling water is raised and reaches a specified temperature (for example, 90° C.).

In the radiator circuit 5 having the above configuration, in the state that the water pump 14 operates and the second flow rate control valve 17 is opened, if the thermostat 19 opens as the temperature of the cooling water is raised, the cooling water flowing out from the second cooling water outlet 2*c* of the engine 2 circulates in a manner of flowing in order through the upstream portion 5*a* of the radiator circuit 5, the radiator 18, the thermostat 19 and the downstream portion 5*b*, and returns to the engine 2 via the cooling water inlet 2*b*. Thereby, the heat of the high-temperature cooling water is dissipated from the radiator 18 to the outside. On the other hand, when the cooling water is below the specified temperature, the thermostat 19 is maintained at a closed state, and thereby the circulation of the cooling water in the radiator circuit 5 does not occur, and the heat dissipation from the radiator 18 to the outside is not performed.

In addition, near the cooling water outlet 2*a* of the engine 2, an engine water temperature sensor 51 for detecting the temperature of the cooling water (hereinafter, referred to as an "engine water temperature TW") is arranged. A detection signal of the engine water temperature sensor 51 is output to an ECU 10 (an electronic control unit) (see FIG. 2). In addition, a detection signal representing a rotation speed (an engine rotation speed) NE of the engine 2 is input from an engine rotation speed sensor 52 to the ECU 10. Furthermore, a detection signal representing an on/off state of a starter (not shown) of the engine 2 is input from a starter switch 53 to the ECU 10, and a detection signal representing presence or absence of a request of heating the vehicle is input from an air conditioner switch 54 to the ECU 10.

Figure 2:
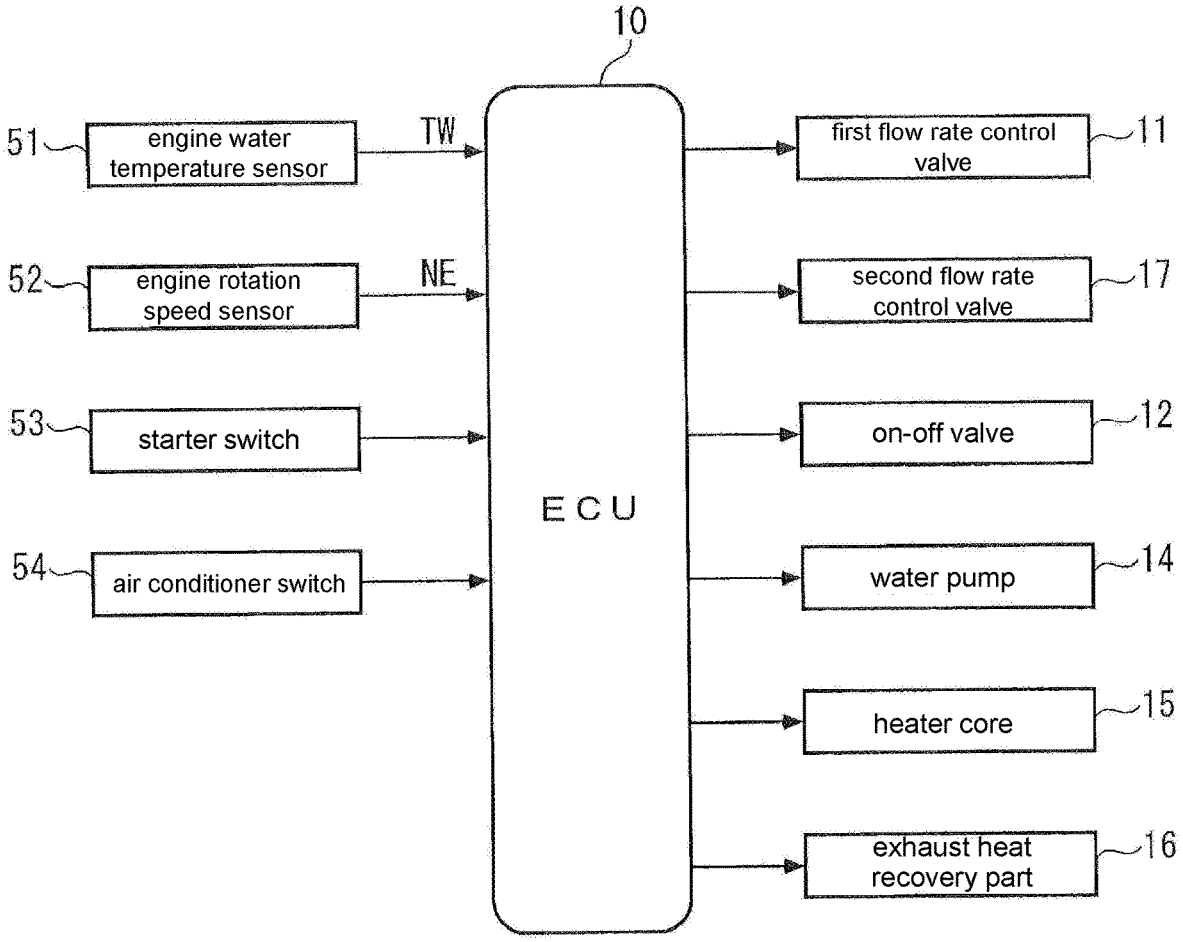
FIG. 2 is a block diagram showing an input/output relationship of control in the cooling water control apparatus.

The ECU 10 is configured by a microcomputer including a CPU, a RAM, a ROM, an I/O interface (none of the parts are shown), and the like. As shown in FIG. 2, the ECU 10 controls, according to the detection signals and the like from the sensors 51 and 52 and the switches 53 and 54, the flow and the like of the cooling water by controlling operations of the above various devices of the cooling water control apparatus 1 (the water pump 14, the first flow rate control valve 11, the second flow rate control valve 17, the on-off valve 12, the heater core 15, and the exhaust heat recovery part 16).

The ECU 10 executes, particularly in the embodiment, a cooling water control process at the start shown in FIG. 3 which controls the flow of the cooling water at the start of the engine 2. The process is repeatedly executed, for example, at a specified cycle.

In the process, first, in step 1 (illustrated as "S1", the same applies hereinafter), a determination on whether the start of the engine 2 is requested is made according to the detection signal of the starter switch 53. When the answer is NO, the process is ended directly.

When the answer in step 1 is YES and the start of the engine 2 is requested, a determination on whether a heat dissipation control end flag F_ESTEND is "1" and a determination on whether a heat dissipation control flag F_EST is "1" are respectively made (steps 2 and 3). As described later, the heat dissipation control end flag F_ESTEND is set to "1" when the heat dissipation by the supply of the cooling water from the heat accumulator 13 to the engine 2 (hereinafter, referred to as "heat dissipation control") is ended, and the heat dissipation control flag F_EST is set to "1" during the execution of the heat dissipation control.

When these answers are both NO and the heat dissipation control is not executed, a determination is made on whether the detected engine water temperature TW is below a specified temperature TREF. When the answer is NO, the temperature at the start of the engine 2 is high and it is not necessary to execute the heat dissipation control for warming up, and the process is ended directly.

On the other hand, when the answer in step 4 is YES, the engine 2 is in the cold start state, and thus in step 5 and subsequent steps, the heat dissipation control is executed to promote the warm-up. Specifically, the on-off valve 12 is controlled to an open state (step 5), an opening degree of the first flow rate control valve 11 (hereinafter, referred to as a "first valve opening degree") AV1 is controlled to a specified opening degree AREF (step 6), and an opening degree of the second flow rate control valve 17 (hereinafter, referred to as a "second valve opening degree") AV2 is controlled to the value 0, that is, the second flow rate control valve 17 is in a fully closed state (step 7). Then, in order to indicate that the heat dissipation control is being executed, the heat dissipation control flag F_EST is set to "1" (step 8), and the process is ended.

Figure 5:
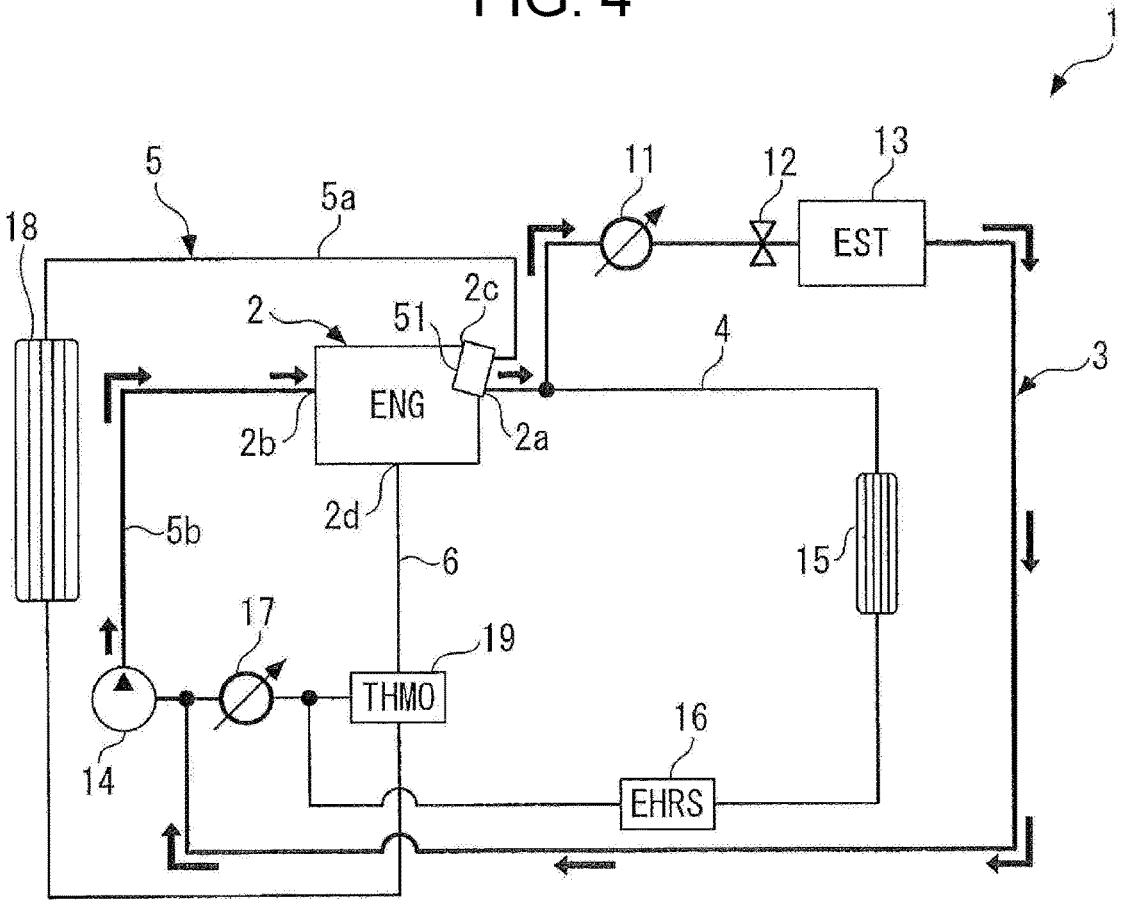
FIG. 5 is an explanatory diagram for illustrating flow of cooling water in a heat dissipation control from a heat accumulator.

As described above, in the heat dissipation control, the first flow rate control valve 11 and the on-off valve 12 are controlled to an open state, and thus, as shown in FIG. 5, the cooling water flowing out from the cooling water outlet 2*a* of the engine 2 flows to a side of the cooling water circuit 3, and thereby the high-temperature cooling water stored in the heat accumulator 13 is discharged. Accordingly, the high-temperature cooling water inside the heat accumulator 13 is supplied to the engine 2 and the heat of the cooling water is dissipated, and thereby the warm-up is promoted. Moreover, in FIG. 5 and FIG. 6 which is described later, flow paths through which the cooling water flows are indicated by thick lines, directions of the flow are indicated by arrows, and flow paths through which the cooling water does not flow are indicated by thin lines.

In addition, because the second flow rate control valve 17 is controlled in a fully closed state, the cooling water flowing out from the engine 2 flows only to the cooling water circuit 3 and does not flow to the heater passage 4. Therefore, the low-temperature cooling water inside the heater passage 4 is not supplied to the engine 2 and is not mixed into the high-temperature cooling water from the heat accumulator 13. Therefore, the heat from the heat accumulator 13 can be efficiently dissipated, and the warm-up can be effectively promoted.

Returning to FIG. 3, when the heat dissipation control flag F_EST is set to "1" in step 8, the answer in step 3 is YES thereafter. In that case, the process proceeds to step 9 to calculate a supply amount QEST of the cooling water from the heat accumulator 13 to the engine 2 during the heat dissipation control. The cooling water supply amount QEST is calculated based on, for example, a sending capability of the water pump 14, the first valve opening degree AV1, the engine rotation speed NE, an elapsed time from the start of the heat dissipation control, and the like.

Next, a determination is made on whether the cooling water supply amount QEST is equal to or higher than a specified amount QREF (step 10). When the answer is NO, the process is ended directly and the heat dissipation control is continued. On the other hand, when the answer in step 10 is YES, it is assumed that the high-temperature cooling water stored in the heat accumulator 13 has been used up, and the heat dissipation control is ended in step 11 and subsequent steps. Specifically, the on-off valve 12 is controlled to the closed state (step 11), and the first valve opening degree AV1 is controlled to the value 0, that is, the first flow rate control valve 11 is controlled to a fully closed state (step 12). Then, the heat dissipation control flag F_EST is reset to "0" (step 13), and the heat dissipation control end flag F_ESTEND is set to "1" in order to indicate that the heat dissipation control is ended (step 14).

After step 14 or when the answer in step 2 becomes YES along with the execution of step 14, a determination on whether heating of the vehicle is requested is made according to the detection signal of the air conditioner switch 54 (step 15). When the answer is NO, a calculation process of the second valve opening degree AV2 is executed (step 16), and the process is ended.

FIG. 4 shows the calculation process of the second valve opening degree AV2. The process calculates the second valve opening degree AV2 by feedback control to make the detected engine water temperature TW converge to a specified target temperature TWCMD.

In the process, first, in step 21, a basic value AVBS of the second valve opening degree AV2 is calculated. The basic value AVBS is calculated, for example, by searching a specified map (not shown) according to the engine water temperature TW and the engine rotation speed NE.

Next, a difference between the target temperature TWCMD and the engine water temperature TW is calculated as a temperature deviation DT (step 22). The target temperature TWCMD is set to a specified lower limit value (for example, 60° C.) at which a reduction in fuel consumption is caused when the engine water temperature TW is lower than the target temperature TWCMD.

Next, based on the calculated temperature deviation DT, a feedback correction term AVFS is calculated by, for example, PID feedback control to make the engine water temperature TW converge to the target temperature TWCMD (step 23).

Finally, the second valve opening degree AV2 is calculated by adding the feedback correction term AVFS to the basic value AVBS calculated as described above (step 24), and the process is ended.

Figure 6:
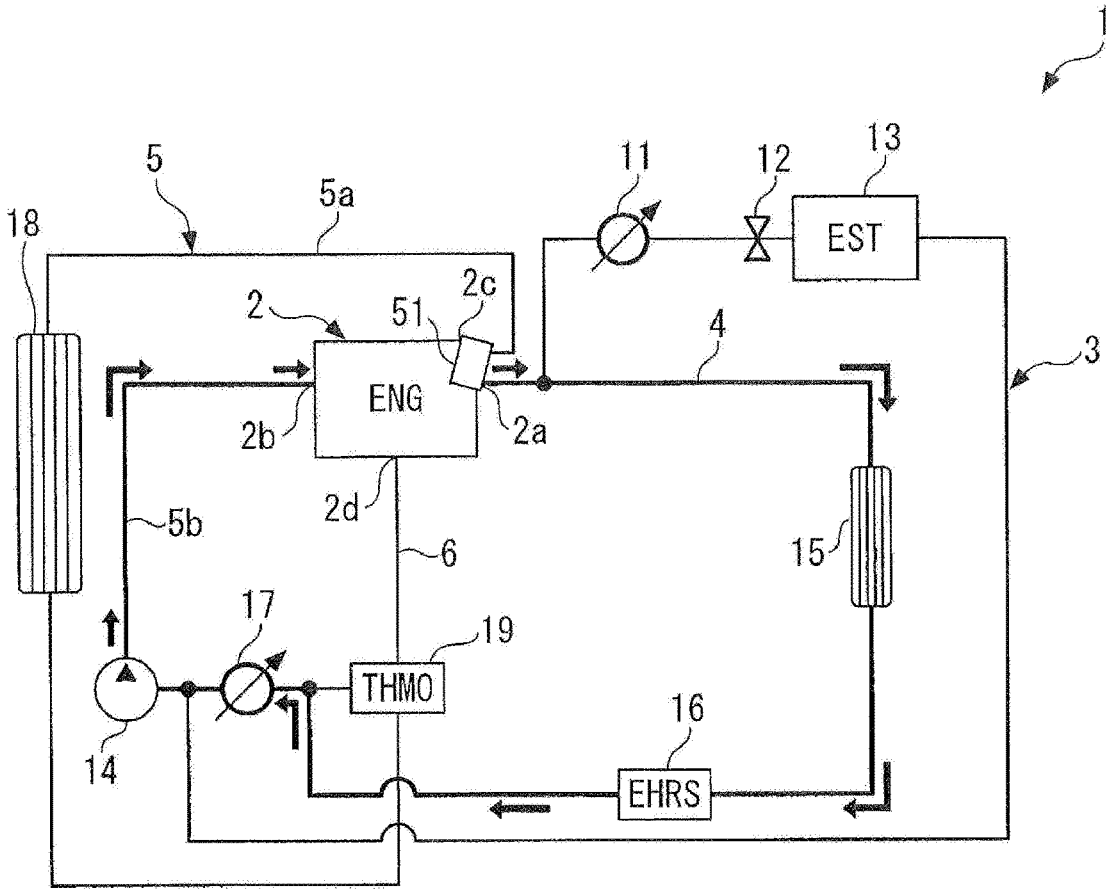
FIG. 6 is an explanatory diagram similar to FIG. 5 after the heat dissipation control from the heat accumulator.

As described above, at the start of the engine 2, after the heat dissipation control is ended, the first flow rate control valve 11 and the on-off valve 12 are controlled to the closed state, and the second flow rate control valve 17 is opened. Therefore, as shown in FIG. 6, the cooling water flowing out from the engine 2 flows only to a side of the heater passage 4 and does not flow to the cooling water circuit 3, and thus the cooling water is not discharged from the heat accumulator 13.

In addition, the second valve opening degree AV2 at this time is calculated by the feedback control to make the detected engine water temperature TW converge to the target temperature TWCMD. Accordingly, after the heat dissipation control is ended, an actual engine temperature can be precisely controlled to the target temperature TWCMD, the reduction in engine temperature caused by the flow-in of the low-temperature cooling water via the heater passage 4 is suppressed, and the warm-up effect is maintained, thereby improving fuel consumption and exhaust characteristics.

Returning to FIG. 3, when the answer in step 15 is YES and the heating of the vehicle is requested, the second valve opening degree AV2 is controlled to a fully open opening degree AMAX (step 17), and the process is ended. Thereby, the heating of the vehicle can be performed with priority while maximally utilizing the heat of the cooling water in the heater core 15.

Next, a calculation process of the second valve opening degree AV2 according to a second embodiment is described with reference to FIG. 7. The calculation process is executed in step 16 of FIG. 3 in place of the calculation process according to the first embodiment shown in FIG. 4, and is different from the first embodiment in that the second valve opening degree AV2 is calculated by feed-forward control.

In the process, first, in step 31, the temperature of the cooling water in the heater passage 4 at the beginning of the start of the engine 2 (hereinafter, referred to as a "start beginning water temperature") TWSTR is calculated. The start beginning water temperature TWSTR is calculated by searching a specified map (not shown) according to, for example, the engine water temperature TW which is detected and stored at the stop closest to current start of the engine 2 and a stop time from the above stop to the beginning of the current start.

Next, the after-start fuel injection amount QFUEL is calculated (step 32). The after-start fuel injection amount QFUEL is an integrated value of a fuel injection amount injected from a fuel injection valve (not shown) from the beginning of the current start of the engine 2 to the present time point.

Finally, the second valve opening degree AV2 is calculated with reference to the specified map according to the start beginning water temperature TWSTR and the after-start fuel injection amount QFUEL (step 33), and the process is ended. Although not shown, this map is obtained in a manner that the second valve opening degree AV2 with which the engine water temperature TW becomes the target temperature TWCMD is obtained in advance by experiment or the like for the start beginning water temperature TWSTR and the after-start fuel injection amount QFUEL and is mapped.

As described above, according to the embodiment, the second valve opening degree AV2 is calculated based on the start beginning water temperature TWSTR and the after-start fuel injection amount QFUEL and by feed-forward control to make the engine water temperature TW become the target temperature. Accordingly, by the feed-forward control which is simpler than the feedback control in the first embodiment, the engine water temperature TW can be controlled to the target temperature TWCMD and the warm-up effect can be maintained.

Moreover, the disclosure is not limited to the described embodiment and can be implemented in various aspects. For example, in the embodiment, the first flow rate control valve 11 and the on-off valve 12 are disposed on the upstream side of the heat accumulator 13 in the cooling water circuit 3, but the first flow rate control valve 11 and the on-off valve 12 may also be disposed on a downstream side. Similarly, the second flow rate control valve 17 is disposed on the downstream side of the heater core 15 in the heater passage 4, but the second flow rate control valve 17 may also be disposed on an upstream side. In addition, one of the first flow rate control valve 11 and the on-off valve 12 arranged in the cooling water circuit 3 can be omitted.

In addition, in the embodiment, the heater core 15 is illustrated as the separate equipment arranged in the bypass passage which bypasses the heat accumulator 13; however, other appropriate equipment which utilizes the heat of the cooling water may be used. Furthermore, in the second embodiment, the fuel injection amount is used as the output parameter of the engine 2; however, any parameter can be used as long as the output or the heat amount generated in the engine 2 is appropriately represented. For example, an intake air amount, an opening degree of an accelerator pedal of the vehicle, the engine rotation speed, and the like may be used.

Figure 1:
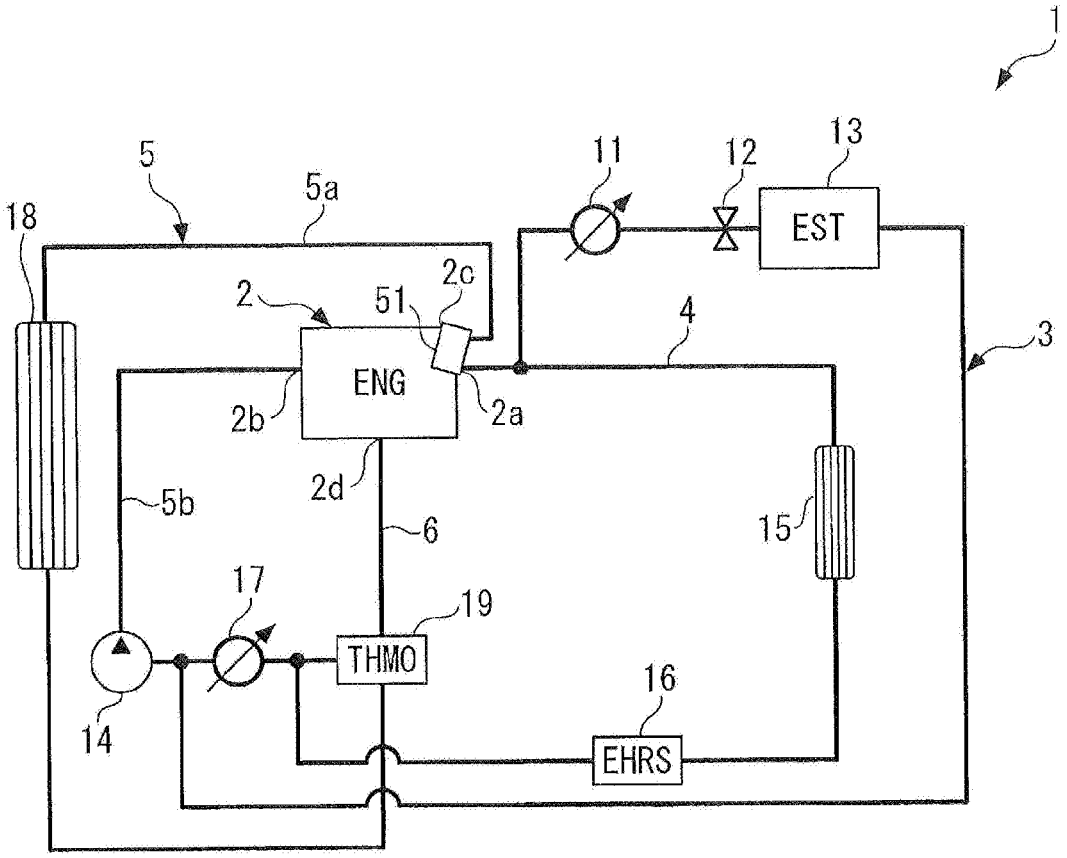
FIG. 1 is a diagram showing a hardware configuration of a cooling water control apparatus for internal combustion engine according to an embodiment of the disclosure.

In addition, the configuration of the cooling water control apparatus 1 shown in FIG. 1 and the like is merely an example, and for example, the exhaust heat recovery part 16 may be omitted. Additionally, detailed configuration can be changed within the scope of the gist of the disclosure.

What is claimed is:

1. A cooling water control apparatus for an internal combustion engine, the cooling water control apparatus comprising:

a cooling water circuit which is connected to the internal combustion engine by a first end of the cooling water circuit connected to a cooling water outlet of the internal combustion engine and a second end of the cooling water circuit connected to a cooling water inlet of the internal combustion engine, such that cooling water circulates in the cooling water circuit and through the internal combustion engine due to operation of a water pump arranged in the cooling water circuit;

a heat accumulator which is arranged in the cooling water circuit and configured to accumulate heat of the cooling water by storing high-temperature cooling water flowing out from the cooling water outlet of the internal combustion engine;

an on-off valve which is arranged in the cooling water circuit and configured to allow a flow of the cooling water to pass through the heat accumulator while in an open state or block the flow of the cooling water passing through the heat accumulator while in a closed state;

a bypass passage which is connected to the internal combustion engine and arranged parallel to the cooling water circuit by branching from an upstream side of the on-off valve and joining at an upstream side of the water pump, the bypass passage configured to bypass the heat accumulator and direct the flow of the cooling water through a heater component arranged in the bypass passage;

a flow rate control valve which is arranged in the bypass passage and configured to control a flow rate of the cooling water through the bypass passage based on an opening degree of the flow rate control valve; and a control part configured to, in order to promote warm-up at a start of the internal combustion engine, supply the cooling water stored inside the heat accumulator through only the cooling water circuit and to the internal combustion engine by controlling the on-off valve to the open state and controlling the flow rate control valve to a fully closed state, and thereafter, supply the cooling water through only the bypass passage and to the internal combustion engine by controlling the on-off valve to the closed state and controlling the opening degree of the flow rate control valve to make a temperature of the internal combustion engine reach a specified target temperature.

2. The cooling water control apparatus according to claim 1, further comprising a cooling water temperature detection part which detects a temperature of the cooling water at the cooling water outlet of the internal combustion engine as the temperature of the internal combustion engine, wherein the control part controls the opening degree of the flow rate control valve by feedback control to make the temperature of the cooling water being detected converge to the specified target temperature.

3. The cooling water control apparatus according to claim 1, further comprising:

a cooling water temperature acquisition part which acquires a temperature of the cooling water at the start of the internal combustion engine; and an output parameter acquisition part which acquires an output parameter representing an output of the internal combustion engine, the output parameter generated after the start of the internal combustion engine; wherein the control part controls, based on the temperature of the cooling water and the output parameter acquired, the opening degree of the flow rate control valve by feed-forward control to make the temperature of the internal combustion engine reach the specified target temperature.

4. The cooling water control apparatus according to claim 1, wherein the specified target temperature is set to a specified lower limit value at which a reduction in fuel consumption is caused when the temperature of the internal combustion engine is lower than the specified target temperature.

5. The cooling water control apparatus according to claim 1, wherein the internal combustion engine is equipped in a vehicle, and the heater component is a heater core for heating the vehicle.

6. The cooling water control apparatus according to claim 5, wherein the control part controls the flow rate control valve to a fully open state regardless of a relationship between the temperature of the internal combustion engine and the specified target temperature when heating of the vehicle is requested after the cooling water stored inside the heat accumulator is supplied to the internal combustion engine.

* * * * *